US011104140B2

(12) United States Patent
Igarashi

(10) Patent No.: US 11,104,140 B2
(45) Date of Patent: Aug. 31, 2021

(54) LIQUID DISCHARGE APPARATUS AND HEAD MAINTENANCE METHOD

(71) Applicant: Ricoh Company, Ltd., Tokyo (JP)

(72) Inventor: Masanori Igarashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/732,379

(22) Filed: Jan. 2, 2020

(65) Prior Publication Data

US 2020/0238707 A1 Jul. 30, 2020

(30) Foreign Application Priority Data

Jan. 30, 2019 (JP) ..... JP2019-014533

(51) Int. Cl.
*B41J 2/165* (2006.01)

(52) U.S. Cl.
CPC ..... *B41J 2/16532* (2013.01); *B41J 2/16505* (2013.01); *B41J 2/16511* (2013.01); *B41J 2/16517* (2013.01); *B41J 2/16523* (2013.01); *B41J 2/16526* (2013.01); *B41J 2002/16514* (2013.01)

(58) Field of Classification Search
CPC ..... B41J 2002/16514; B41J 2/16532; B41J 2/16526; B41J 2/16517; B41J 2/16523; B41J 2/16511; B41J 2/16505
See application file for complete search history.

(56) References Cited

U.S. PATENT DOCUMENTS

| | | | | |
|---|---|---|---|---|
| 9,180,670 | B2 * | 11/2015 | Ogawa | B41J 2/16511 |
| 2011/0057998 | A1 | 3/2011 | Igarashi | |
| 2011/0221801 | A1 | 9/2011 | Igarashi | |
| 2012/0007903 | A1 | 1/2012 | Igarashi | |
| 2012/0056933 | A1 | 3/2012 | Tanaka et al. | |
| 2012/0306950 | A1 | 12/2012 | Kobayashi et al. | |
| 2013/0321501 | A1 | 12/2013 | Igarashi | |
| 2017/0165971 | A1 | 6/2017 | Igarashi | |

FOREIGN PATENT DOCUMENTS

| | | |
|---|---|---|
| JP | 2007-190848 | 8/2007 |
| JP | 2007-276303 | 10/2007 |
| JP | 2012-051274 | 3/2012 |

* cited by examiner

*Primary Examiner* — Geoffrey S Mruk
(74) *Attorney, Agent, or Firm* — Xsensus LLP

(57) ABSTRACT

A liquid discharge apparatus includes a liquid discharge head configured to discharge a liquid, a cap configured to approachably separable from the liquid discharge head, a suction pump connected to the cap, and circuitry configured to control the cap and the suction pump to perform a maintenance operation. The maintenance operation includes a head suction operation to cap the liquid discharge head with the cap and drive the suction pump to vacuum the liquid from the liquid discharge head, an in-cap suction operation to move the cap away from the liquid discharge head and drive the suction pump to discharge the liquid from the cap, and a cap approaching operation to move the cap away from the liquid discharge head after moving the cap toward the liquid discharge head.

11 Claims, 11 Drawing Sheets

HEAD SUCTION

DE-CAP
(SEPARATE CAP FROM HEAD)

WIPING AND SUCK LIQUID IN CAP

RAISE CAP

BREAK BUBBLE

LOWER CAP

LIQUID DISCHARGE APPARATUS AND HEAD MAINTENANCE METHOD

CROSS-REFERENCE TO RELATED APPLICATION

This patent application is based on and claims priority pursuant to 35 U.S.C. § 119(a) to Japanese Patent Application No. 2019-014533, filed on Jan. 30, 2019 in the Japan Patent Office, the entire disclosure of which is hereby incorporated by reference herein.

BACKGROUND

Technical Field

Aspects of the present disclosure relate to a liquid discharge apparatus and a head maintenance method.

Related Art

A liquid discharge apparatus including a liquid discharge head (recording head) includes a maintenance recovery mechanism (maintenance device) including, e.g., a cap to cap a nozzle surface of the liquid discharge head, a suction device connected to the cap, for example, to perform maintenance and recovering a state of the liquid discharge head 9.

The liquid discharge apparatus includes a pressure adjusting unit that fluctuates and absorbs ink pressure. The pressure adjusting unit is mounted on the recording head that discharges ink droplets of a plurality of colors. A cleaning operation includes an ink suction operation to vacuum ink from the recording head and a dummy suction operation to discharge the ink that is discharged from the recording head and is remained in the cap. The liquid discharge apparatus performs flushing to discharge ink in the nozzles of the recording head between the ink suction operation and the dummy suction operation during the cleaning operation.

SUMMARY

In an aspect of this disclosure, a liquid discharge apparatus is provided that includes a liquid discharge head configured to discharge a liquid, a cap configured to approachably separable from the liquid discharge head, a suction pump connected to the cap, and circuitry configured to control the cap and the suction pump to perform a maintenance operation. The maintenance operation includes a head suction operation to cap the liquid discharge head with the cap and drive the suction pump to vacuum the liquid from the liquid discharge head, an in-cap suction operation to move the cap away from the liquid discharge head and drive the suction pump to discharge the liquid from the cap, and a cap approaching operation to move the cap away from the liquid discharge head after moving the cap toward the liquid discharge head.

In still another aspect of this disclosure, a head maintenance method of maintaining a liquid discharge head that discharges a liquid is provided. The head maintenance method includes performing a head suction operation configured to cap the liquid discharge head with a cap and drive a suction pump connected to the cap to discharge a liquid from the liquid discharge head, performing an in-cap suction operation to move the cap away from the liquid discharge head and drive the suction pump to discharge the liquid from the cap, and performing a cap approaching operation to move the cap away from the liquid discharge head after moving the cap toward the liquid discharge head.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
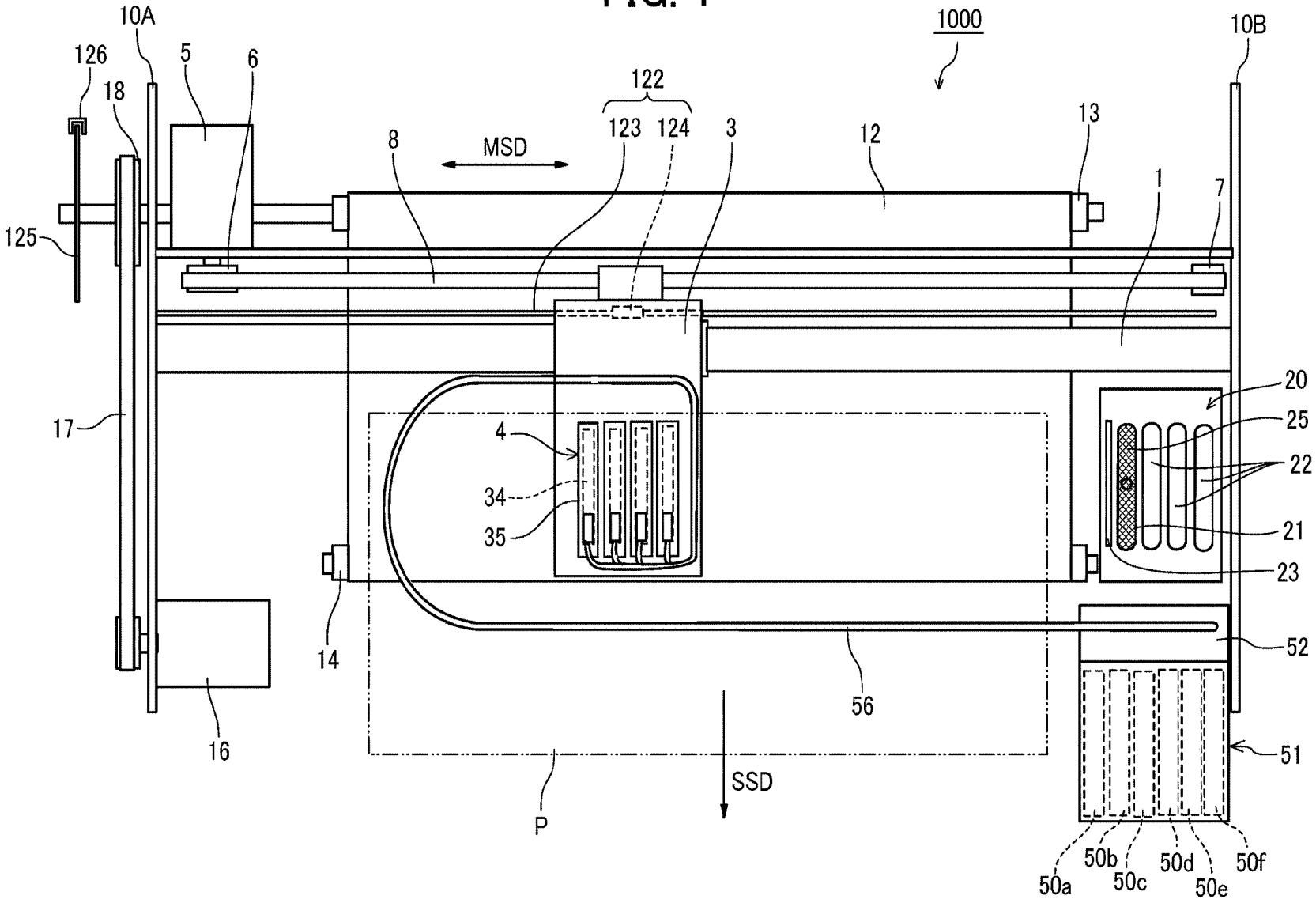
FIG. 1 is a plan view of an example of a mechanism of a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Figure 2:
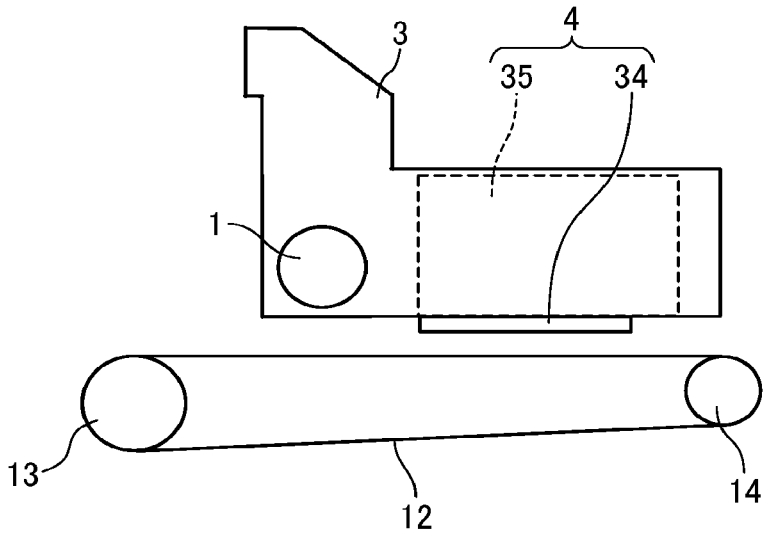
FIG. 2 is a side view of a portion of the liquid discharge apparatus.
Figure 3:
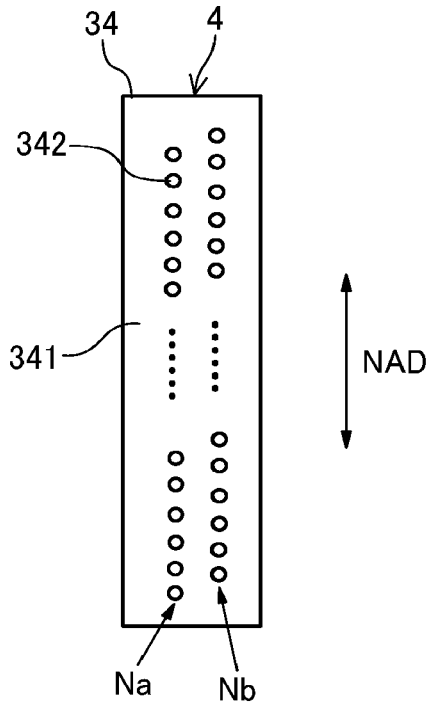
FIG. 3 is a schematic plan view of a configuration of a liquid discharge head of the liquid discharge apparatus.

Referring now to the drawings, wherein like reference numerals designate identical or corresponding parts throughout the several views, embodiments of the present disclosure are described below. A liquid discharge apparatus according to a first embodiment of the present disclosure is described with reference to FIGS. 1 to 3. FIG. 1 is a schematic plan view of a mechanism of the liquid discharge apparatus 1000. FIG. 2 is a schematic side view of a main part of the liquid discharge apparatus 1000. FIG. 3 is a schematic plan view of a configuration of the liquid discharge head 34 of the liquid discharge apparatus 1000 of FIGS. 1 and 2. Note that FIG. 3 illustrates a transparent view of the liquid discharge head 34 viewed from above the liquid discharge head 34.

The liquid discharge apparatus 1000 is a serial-type printer. The guide 1 is bridged between a left-side plate 10A and a right-side plate 10B to reciprocally movably hold a carriage 3 in a main scanning direction indicated by arrow "MSD" in FIG. 1. The carriage 3 is reciprocally moved in the main scanning direction MSD by the main-scanning motor 5 via the timing belt 8 bridged between the driving pulley 6 and the driven pulley 7.

Four liquid discharge devices 4 are mounted on the carriage 3. Each of the liquid discharge devices 4 includes a liquid discharge head 34 that discharges a liquid and a head tank 35 as a sub-tank to form a single unit of the liquid discharge device 4. Hereinafter, the liquid discharge head is simply referred to as the "head".

As illustrated in FIG. 3, the head 34 includes two nozzle arrays Na and Nb on a nozzle surface 341 of the head 34. Each of the nozzle arrays Na and Nb includes a plurality of nozzles 342 arranged in a nozzle array direction indicated by arrow "NAD" in FIG. 3. Eight nozzle arrays Na and Nb of four heads 34 discharge the liquid of, for example, black (K), cyan (C), magenta (M), yellow (Y), white (W), and transparent (V) assigned to each of the nozzle arrays Na and Nb of the heads 34.

Each of the head tanks 35 includes a tank unit that stores liquid of respective colors supplied to the heads 34 for the respective colors.

A cartridge holder 51 is disposed at an apparatus body of the liquid discharge apparatus 1000. Main tanks 50 (50*a* to 50*f*) to contain liquid of the respective colors are removably mounted to the cartridge holder 51. The cartridge holder 51 includes a liquid feed pump unit 52. The liquid feed pump unit 52 supplies liquid of the respective colors from the main tanks 50 to the tank portions of the head tanks 35 via supply tubes 56 (also referred to as supply channels) for the respective colors.

To convey a sheet material P, the liquid discharge apparatus 1000 also includes a conveyance belt 12 as a conveyor to attract the sheet material P and convey the sheet material P to a position facing the head 34. The conveyance belt 12 is an endless belt stretched between a conveyance roller 13 and a tension roller 14. The sheet material P is attracted to the conveyance belt 12 by electrostatic attraction or air attraction.

The conveyance belt 12 cyclically rotates in a sub-scanning direction indicated by arrow "SSD" in FIG. 1, as the conveyance roller 13 is rotationally driven by the sub-scanning motor 16 via the timing belt 17 and the timing pulley 18.

On one side in the main scanning direction MSD of the carriage 3, a maintenance unit 20 to maintain and recover the heads 34 is disposed at a lateral side of the conveyance belt 12.

The maintenance unit 20 includes, for example, one suction cap 21, three moisture-retention caps 22, and a wiper 23. The suction cap 21 and the moisture-retention caps 22 cap the nozzle surface 341 of the head 34. The suction cap 21 also serves as the moisture-retention cap 22. The wiper 23 wipes the nozzle surface 341.

The suction cap 21 includes an absorber 25. The suction cap 21 and the moisture-retention cap 22 are driven by a common drive source at the same timing to move toward the head 34 to a capping position to contact and cap the head 34 and to move away from the head 34 to a de-capped position to be separated from the head 34.

As illustrated in FIG. 1, an encoder scale 123, on which a predetermined pattern is formed, is stretched between the left-side plate 10A and the right-side plate 10B along the main scanning direction MSD of the carriage 3. The carriage 3 includes an encoder sensor 124 formed of a transmissive photosensor that reads the predetermined pattern on the encoder scale 123. As illustrated in FIG. 1, the encoder scale 123 and the encoder sensor 124 configure a linear encoder 122 (main-scanning encoder) that detects a movement of the carriage 3.

A code wheel 125 is mounted on the shaft of the conveyance roller 13, and an encoder sensor 126 comprising a transmissive photosensor that detects a pattern formed on the code wheel 125 is provided the apparatus body of the liquid discharge apparatus 1000. The code wheel 125 and the encoder sensor 126 configure a rotary encoder (sub-scanning encoder) that detects an amount of movement and the position of the conveyance belt 12.

In the liquid discharge apparatus 1000 thus configured, the sheet material P is fed and attracted onto the conveyance belt 12. With the sheet material P attracted on the conveyance belt 12, the conveyance belt 12 is circulated to convey the sheet material P in the sub-scanning direction SSD.

By driving the heads 34 in accordance with image signals while moving the carriage 3, liquid is discharged onto the sheet material P, which is stopped below the heads 34, to form one line of a desired image. Then, the sheet material P is fed by a predetermined distance to prepare for the next operation to record another line of the image.

The liquid discharge apparatus 1000 ends a recording operation when the liquid discharge apparatus 1000 receives a signal indicating an end of recording or a signal indicating that a rear end of the sheet material P reaches a recording area. Then, the liquid discharge apparatus 1000 eject the sheet material P to an ejection tray outside a housing of the liquid discharge apparatus 1000.

Figure 4:
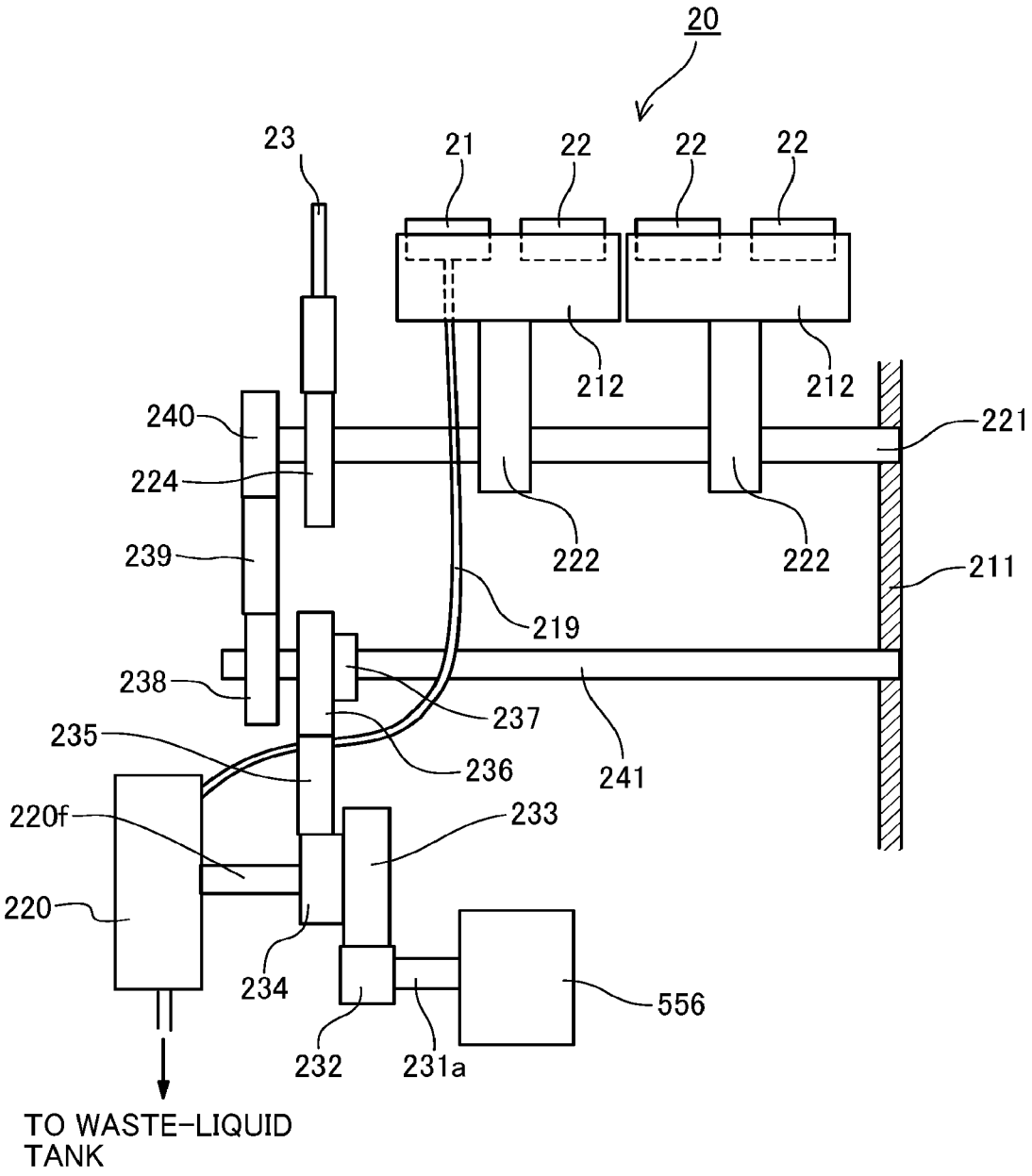
FIG. 4 is a schematic side view of an example of a maintenances unit.

Next, an example of the maintenance unit 20 of the liquid discharge apparatus 1000 is described with reference to FIG. 4. FIG. 4 is a schematic side view of maintenance unit 20 of the liquid discharge apparatus 1000 according to the first embodiment of the present disclosure.

In the maintenance unit 20, the suction cap 21 and the moisture-retention caps 22 held by a cap holder 212, and the wiper 23 including an elastic body are vertically movably held by a maintenance frame 211. Thus, each of the suction cap 21, the moisture-retention caps 22, and the wiper 23 is advanceably retractable.

A suction pump 220 as a suction device is connected to the suction cap 21 through a suction tube 219 made of an elastic member. The suction pump 220 uses a tube pump that generates suction force on the suction tube 219. The suction pump 220 repeats application of pressure on the suction tube 219 with a plurality of pressure members (pressure rollers) and movement of the plurality of pressure members relative to the suction tube 219 to generate the suction force.

A cam shaft 221 rotatably supported by the maintenance frame 211 is disposed below the suction cap 21, the moisture-retention caps 22, and the wiper 23. The cam shaft 221 includes a cap cam 222 to raise and lower the cap holder 212, and a wiper cam 224 to raise and lower the wiper 23.

To rotationally drive the suction pump 220 and the cam shaft 221, a motor gear 232 provided on a motor shaft 231*a* is engaged to a pump gear 233 provided on a pump shaft 220*f* of the suction pump 220 so that rotational force of the maintenance motor 556 is transmitted to the pump gear 233 via the motor gear 232.

Further, an intermediate gear 234 integrated with the pump gear 233 is engaged with an intermediate gear 235. The intermediate gear 235 is engaged with an intermediate gear 236 with a one-way clutch 237. Thus, the rotation force of the maintenance motor 556 is further transmitted to the intermediate gear 236 via the intermediate gear 234 and the intermediate gear 235. An intermediate gear 238 coaxial with the intermediate gear 236 is engaged with a cam gear 240 fixed to a cam shaft 221 via the intermediate gear 239. An intermediate shaft 241 is a rotation shaft of the intermediate gear 238 and the intermediate gears 236 with the one-way clutch 237. The intermediate shaft 241 is rotatably held by the maintenance frame 211.

In the maintenance unit 20, the maintenance motor 556 is driven to raise the wiper 23 via a wiper cam 224. While the wiper 23 is raised by the maintenance motor 556, the carriage 3 moves in the main scanning direction MSD so that the wiper 23 wipes the nozzle surface 341 of the head 34.

To cap and cover the nozzle surface 341 of the head 34 with the suction cap 21 and the moisture-retention caps 22, the maintenance motor 556 is driven to rotate the cap cam 222 to raise the suction cap 21 and the moisture-retention caps 22.

Figure 5:
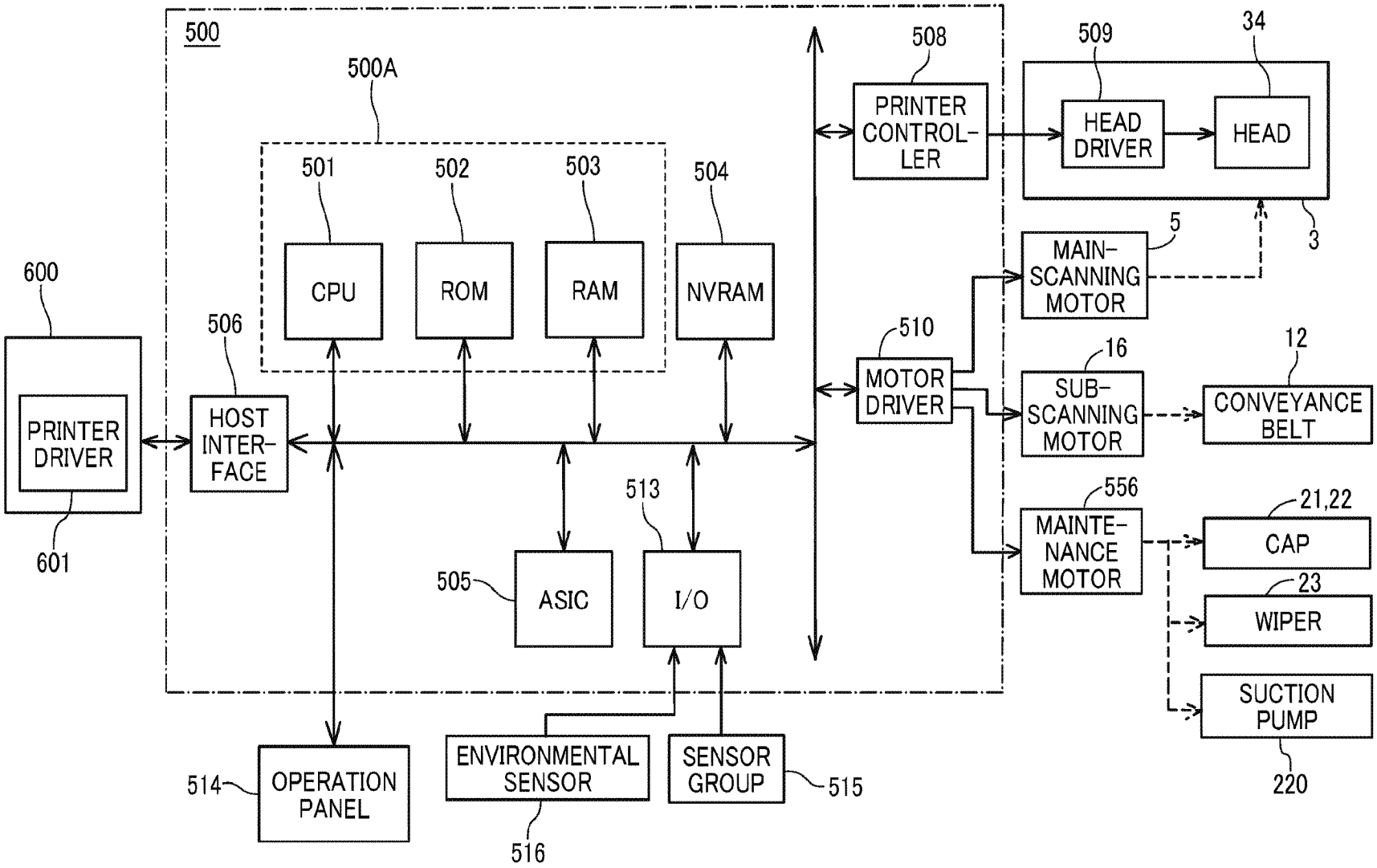
FIG. 5 is a block diagram of a controller of the liquid discharge apparatus according to the first embodiment of the present disclosure.

Next, an outline of a controller 500 of the liquid discharge apparatus 1000 is described with reference to FIG. 5. FIG. 5 is a block diagram of the controller 500 of the liquid discharge apparatus 1000 according to the first embodiment of the present disclosure.

The controller 500 controls entire system of the liquid discharge apparatus 1000. The controller 500 includes a main controller 500A including a central processing unit (CPU 501), a read-only memory (ROM 502), and a random-access memory (RAM 503). The CPU 501 also serves as various controllers such as a controller in the present embodiment. The ROM 502 stores various programs including programs executed by the CPU 501, and other fixed data of the present embodiment. The RAM 503 temporarily stores image data and other data.

The controller 500 further includes a non-volatile random-access memory (NVRAM 504) and an application specific integrated circuit (ASIC 505). The NVRAM 504 is a rewritable memory capable of retaining data even when the apparatus is powered off. The ASIC 505 processes various signals on image data, performs sorting or other image processing, and processes input and output signals to control the entire apparatus.

The controller 500 includes a data transfer unit to drive and control the head 34, a printer controller 508 including a drive signal generator, and a head driver (driver IC 509) to drive the head 34 on the carriage 3.

The controller 500 includes a main-scanning motor 5 that moves and scans the carriage 3, a sub-scanning motor 16 that rotates and moves the conveyance belt 12, and a motor driver 510 that drives the maintenance motor 556 of the maintenance unit 20. The controller 500 drives the maintenance motor 556 to drive the suction pump 220 and raise and lower the suction cap 21, the moisture-retention caps 22, and the wiper as described above.

The controller 500 is coupled to an operation panel 514 (control panel) to input and display information necessary for the liquid discharge apparatus 1000.

The controller 500 includes a host interface (I/F 506) to send and receive data and signals to and from a host 600, such as an information processing apparatus (e.g., a personal computer) or an image reader. The controller 500 receives such data and signals from the host 600 with the I/F 506 via a cable or network.

The CPU 501 of the controller 500 reads out and analyzes print data in a reception buffer included in the I/F 506, performs necessary image processing, data rearrangement processing, and the like by the ASIC 505, and transfers the image data from the printer controller 508 to the head driver 509. Note that generation of dot pattern data for image output is performed by the printer driver 601 of the host 600.

The printer controller 508 transfers the above-described image data as serial data, and outputs to the head driver 509, a transfer clock, a latch signal, a control signal, and the like necessary for transferring the image data and determining the transfer. The printer controller 508 also includes the drive signal generator configured by a digital/analog (D/A) converter, a voltage amplifier, a current amplifier, and the like. The D/A converter performs digital-to-analog (D/A) conversion on the pattern data of the drive pulse stored in the ROM 502. The drive signal generator outputs a drive signal composed of one drive pulse or a plurality of drive pulses to the head driver 509.

In accordance with serially-inputted image data corresponding to one line recorded by the heads 34, the head driver 509 selects drive pulses of a driving signal transmitted from the printer controller 508 and applies the selected drive pulses to a drive element (piezoelectric element, etc.) to drive the head 34. The head 34 includes the drive element that generates energy to discharge a liquid from the head 34. At the time of driving the drive element of the head 34, the controller 500 selects a drive pulse that constitutes a drive signal to separately discharge dots of different sizes, such as large drop, medium drop, and small drop, for example.

An I/O unit 513 acquires information from an environmental sensor 516 mounted on the liquid discharge apparatus 1000 and various types of sensors of the sensor group 515, extracts information necessary for controlling the liquid discharge apparatus 1000, and uses extracted data to control the printer controller 508, the motor driver 510, and the like. The environmental sensor 516 detects environmental conditions of the liquid discharge apparatus 1000.

Here, the main controller 500A also serves as a controller to control the maintenance unit 20 to perform the maintenance operation for the head 34. The CPU 501 executes control of the maintenance unit 20 in accordance with a program according to the present embodiment stored in the ROM 502.

Figure 6:
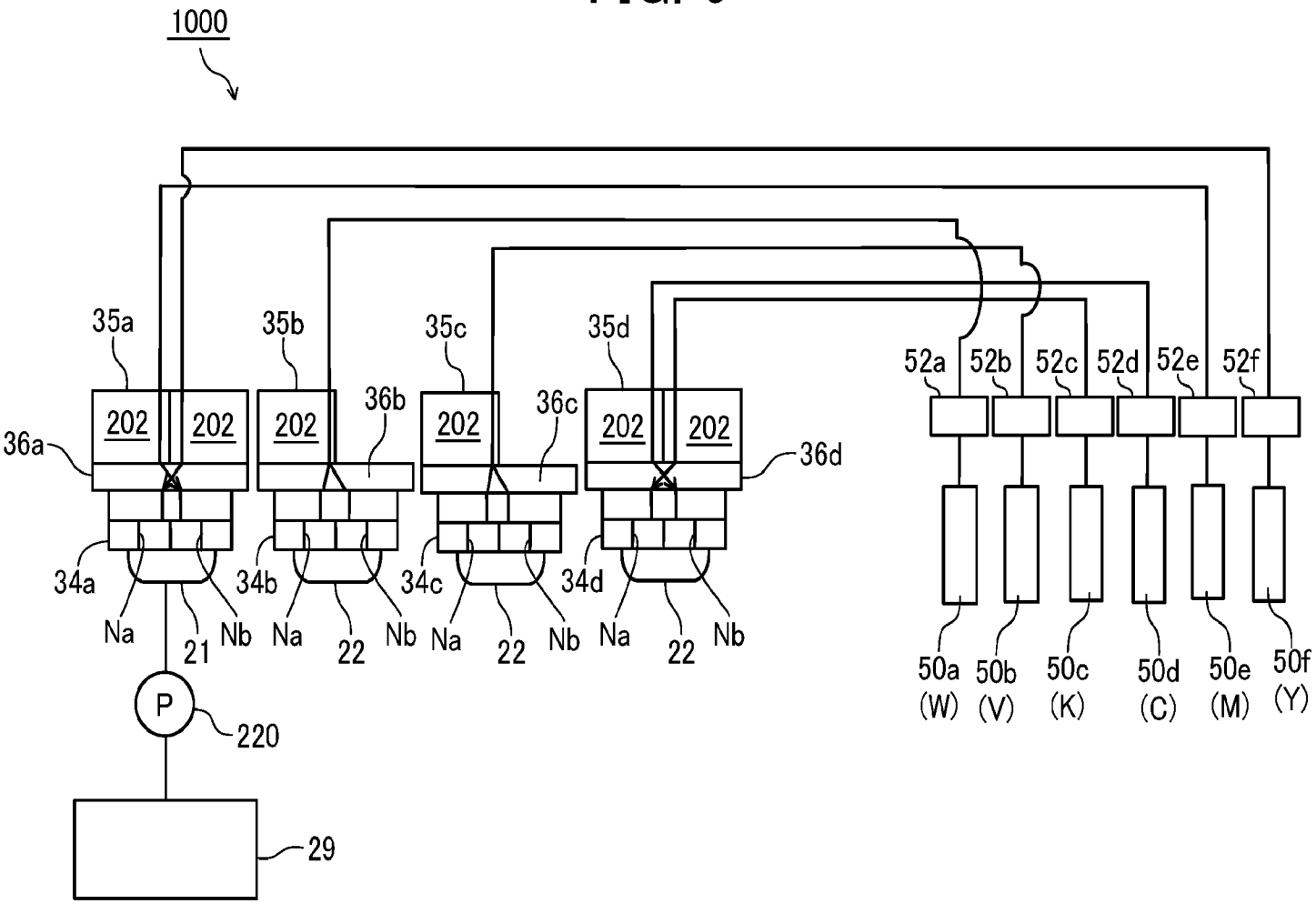
FIG. 6 is a schematic diagram of a supply system and a discharge system of the liquid discharge apparatus according to the first embodiment of the present disclosure.

Next, a supply system and a discharge system of the liquid discharge apparatus 1000 according to the present embodiment is described with reference to FIG. 6. FIG. 6 is a schematic diagram of the supply system and the discharge system of the liquid discharge apparatus 1000.

Liquids of colors of white (W), transparent (V), black (K), cyan (C), magenta (M), and yellow (Y) are assigned to the main tanks 50*a* to 50*f*, respectively. A liquid feed pump 52*a* to 52*f* as a liquid feeder supplies liquid from the main tanks 50*a* to 50*f* to the head tanks 35*a* to 35*d* of the heads 34*a* to 34*d*.

The liquid of magenta (M) is supplied to one of a liquid storage 202 of the head tank 35*a* from the main tank 50*e*. The liquid of yellow (Y) is supplied to another liquid storage 202 of the head tank 35*a* from the main tank 50*f* The Liquid of white (W) is supplied to the head tank 35*b* from the main tank 50*a*. The Liquid of transparent (V) is supplied to the head tank 35*c* from the main tank 50*b*.

The liquid of black (K) is supplied to one of a liquid storage 202 of the head tank 35*d* from the main tank 50*c*. The liquid of cyan (C) is supplied to another liquid storage 202 of the head tank 35*d* from the main tank 50*d*.

The liquid discharge apparatus 1000 includes filter units 36*a* to 36*d* arranged between the head tanks 35*a* to 35*d* and the heads 34*a* to 34*d*. Liquid is supplied to common channels corresponding to the nozzle arrays Na and Nb of the heads 34*a* to 34*d* via internal channels of the filter units 36*a* to 36*d*.

In the liquid discharge apparatus 1000 according to the present embodiment, the liquid of yellow (Y) is discharged from the nozzle array Na of the head 34*a*, and the liquid of magenta (M) is discharged from the nozzle array Nb of the head 34*a*. Both of the nozzle arrays Na and Nb of the head 34*b* discharge the liquid of white (W). Both of the nozzle arrays Na and Nb of the head 34*c* discharge the liquid of transparent (V). The nozzle array Na of the head 34*d* discharges the liquid of black (K), and the nozzle array Nb of the head 34*d* discharges the liquid of cyan (C).

As described above, in the configuration in which the heads 34 that discharge liquids of different colors are sucked by the same suction cap 21, if bubble is generated in the suction cap 21, the bubble may burst and adhere to the nozzle surface 341 when the head 34 that discharges other colors is capped with the suction cap 21. If waste liquid of other colors is adhered to the nozzle surface 341, the waste liquid may enter inside the nozzle 342 and mix with the liquid of other colors in the nozzle 342.

Figure 7:
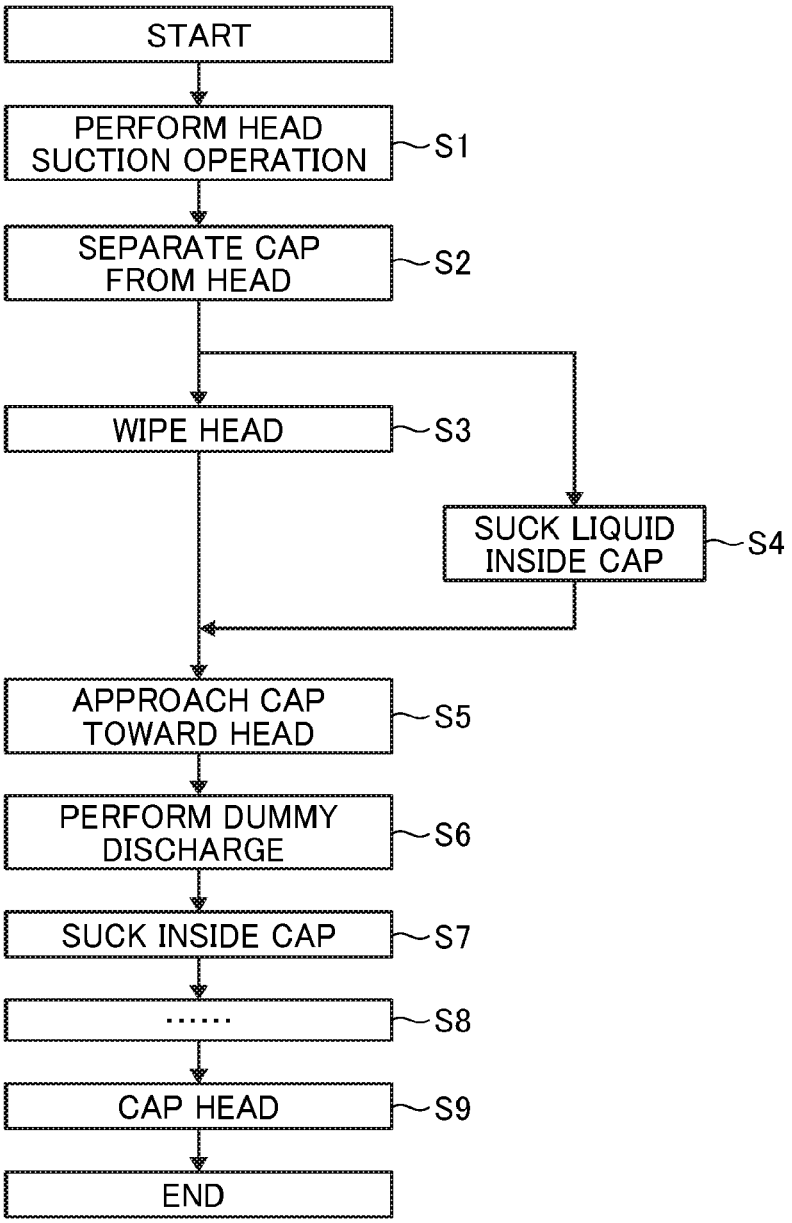
FIG. 7 is a flowchart of a control of a maintenance operation according to the first embodiment of the present disclosure.

Next, control of the maintenance operation by the controller 500 is described with reference to FIGS. 7 and 8. FIG. 7 is a flowchart of the control of the maintenance operation by the controller 500. FIGS. 8A to 8F are side views of the head 34 and the suction cap 21 illustrating the control of the maintenance operation by the controller 500.

Figure 8A:
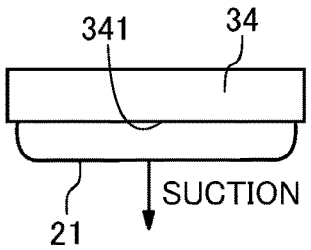
FIGS. 8A to 8F are side views of the liquid discharge head and a suction cap illustrating the control of the maintenance operation.

When the maintenance operation (cleaning operation) is started, the suction cap 21 caps the nozzle surface 341 of the head 34 (target head) that is object to be sucked or vacuumed (cleaned) with the suction cap 21. The suction pump 220 is driven to perform a head suction operation to suck (vacuum) the liquid from the nozzle 342 and discharge the liquid into the suction cap 21 (S1) as illustrated in FIG. 8A and a step "S1" in FIG. 7. Hereinafter, the step S1 is simply referred to as "S1".

The liquid sucked (vacuumed) from the nozzle 342 by the suction cap 21 is discharged to a waste-liquid tank 29 (see FIG. 6) as a waste liquid.

Figure 8B:
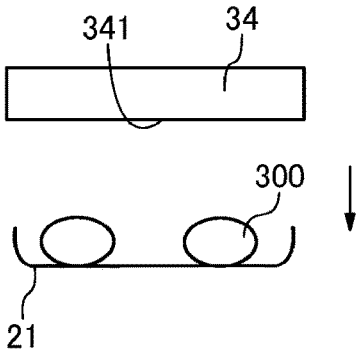
Figure 8C:
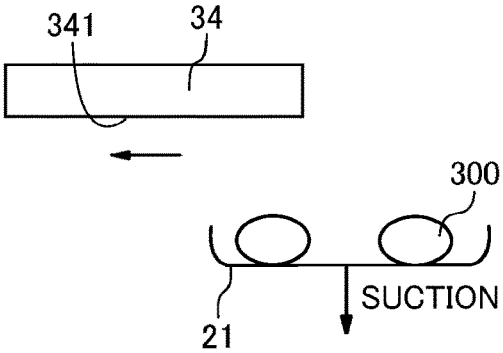

Then, the suction cap 21 is separated (de-capped) from the nozzle surface 341 as illustrated in "open cap" in S2 of FIG. 7 and FIG. 8B. When the suction cap 21 is de-capped from the head 34 (S2), bubbles 300 may be generated in the suction cap 21 as the head 34 is sucked (vacuumed) with the suction cap 21.

Then, the wiper 23 is raised and the carriage 3 is moved to perform wiping of the nozzle surface 341 of the head 34 by the wiper 23 (S3). Further, the suction pump 220 is driven to perform an in-cap suction operation (S4) that sucks (vacuums) the liquid (waste liquid) discharged into the suction cap 21 (see FIG. 8C) outside the suction cap 21. The bubbles 300 in the suction cap 21 generated by the in-cap suction operation (S4) may remain inside the suction cap 21 without disappearing.

Next, the carriage 3 is moved to a head suction position, and a cap approaching operation is performed (S5). The cap approaching operation (S5) moves the suction cap 21 toward and away from the head 34 by a predetermined amount. In the present embodiment, since the suction cap 21 is moved toward and away from the head 34 using the cap cam 222, the predetermined amount of movement of the suction cap 21 is determined by an amount of movement of the suction cap 21 during the suction cap 21 contacts with and separates from the nozzle surface 341 of the head 34.

Figure 8D:
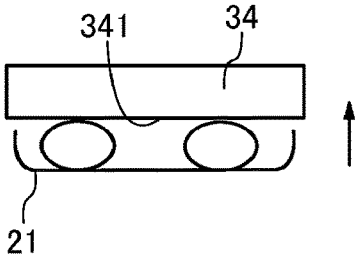
Figure 8E:
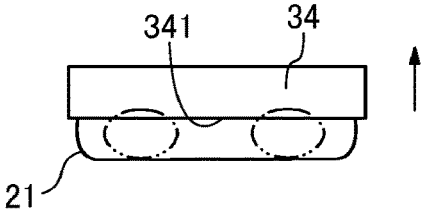
Figure 8F:
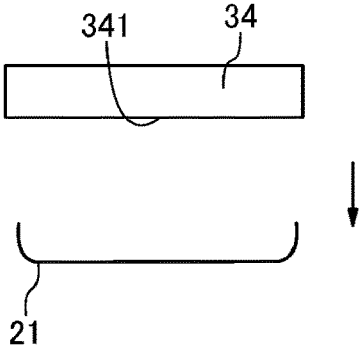

Thus, in the cap approaching operation (S5), the suction cap 21 is raised and brought into contact with the nozzle surface 341 (close cap) as illustrated in FIG. 8D. Thus, the bubbles 300 remaining in the suction cap 21 are broken by coming into contact with the nozzle surface 341 of the head 34 (see FIGS. 8D and 8E). Then, the suction cap 21 is lowered and separated from the nozzle surface 341 (open cap) as illustrated in FIG. 8F.

Next, dummy discharge is performed from the head 34 to an interior of the suction cap 21 (S6 in FIG. 7), and in-cap suction operation (S7) is performed. Then, the nozzle surface 341 of the head 34 is capped with the suction cap 21 and the moisture-retention caps 22 (S9) after performing other operations (S8). Then, the cleaning operation is end.

Thus, the controller 500 performs a first maintenance operation (maintenance operation) that includes the head suction operation (S1), the in-cap suction operation (S2), and the cap approaching operation (S5). The head suction operation (S1) caps the head 34 with the suction cap 21 and drives the suction pump 220 to discharge the liquid from the head 34 to the suction cap 21. The in-cap suction operation (S2) separates the suction cap 21 from the head 34 after the head suction operation (S1) and drives the suction pump 220 to discharge the liquid in the suction cap 21 outside the suction cap 21. The cap approaching operation (S5) moves the suction cap 21 by a predetermined amount toward the head 34 after the in-cap suction operation (S2) and then moves the suction cap 21 away (retract) from the head 34.

If bubbles are generated in the suction cap 21, the cleaning operation performs the cap approaching operation (S5) that contacts bubbles with the nozzle surface 341 of the head 34 to break the bubbles. Thus, the cleaning operation can prevent mixing of a color of a liquid discharged into the suction cap 21 and a color of a liquid of next head 34 of another color when the next head 34 of another color is capped for the head suction operation (S1).

However, in the head 34 that discharges liquids of different colors (yellow (Y) and magenta (M)) such as the head 34*a*, colors (Y and M) of liquids discharged into the suction cap 21 by the head suction operation (S1) are mixed inside the suction cap 21. Thus, the colors of the bubbles 300 in the suction cap 21 are also becomes mixed colors. Thus, if the suction cap 21 is brought close to the nozzle surface 341 of the head 34 to break the bubble 300, the liquids of mixed colors may adhere onto the nozzle surface 341 and enter into the nozzle 342 of the head 34.

Therefore, the controller 500 preferably performs the first maintenance operation including the cap approaching operation when the cleaning operation is performed on the head 34 that discharges a liquid of single color, for example, the heads 34*b* and 34*c* (see FIG. 6) in the present embodiment. Conversely, the controller 500 preferably performs another maintenance operation (second maintenance operation) that does not include the cap approaching operation (S5) when the cleaning operation is performed on the head 34 including nozzle arrays Na and Nb that discharge liquids of different colors, for example, the heads 34*a* and 34*d* (see FIG. 6) in the present embodiment.

Thus, the another maintenance operation (second maintenance operation) includes the head suction operation (S1) and the in-cap suction operation (S2) without the cap approaching operation (S5).

As described above, rotation of the cap cam 222 moves the suction cap 21 toward and away from the head 34. Thus, the suction cap 21 is approachably separable from the head 34. Thus, the suction cap 21 contacts the nozzle surface 341 of the head 34 in the cap approaching operation (S5). However, it is not necessary to make the suction cap 21 to contact the nozzle surface 341 of the head 34 to break only the bubbles protruding from the suction cap 21. If the maintenance unit 20 has a configuration to change a moving amount of the suction cap 21, the maintenance unit 20 can move the suction cap 21 toward (closer to) the nozzle surface 341 by a predetermined amount not contacting the nozzle surface 341 of the head 34 with the suction cap 21 to break the bubbles protrudes outside the suction cap 21.

Figure 9:
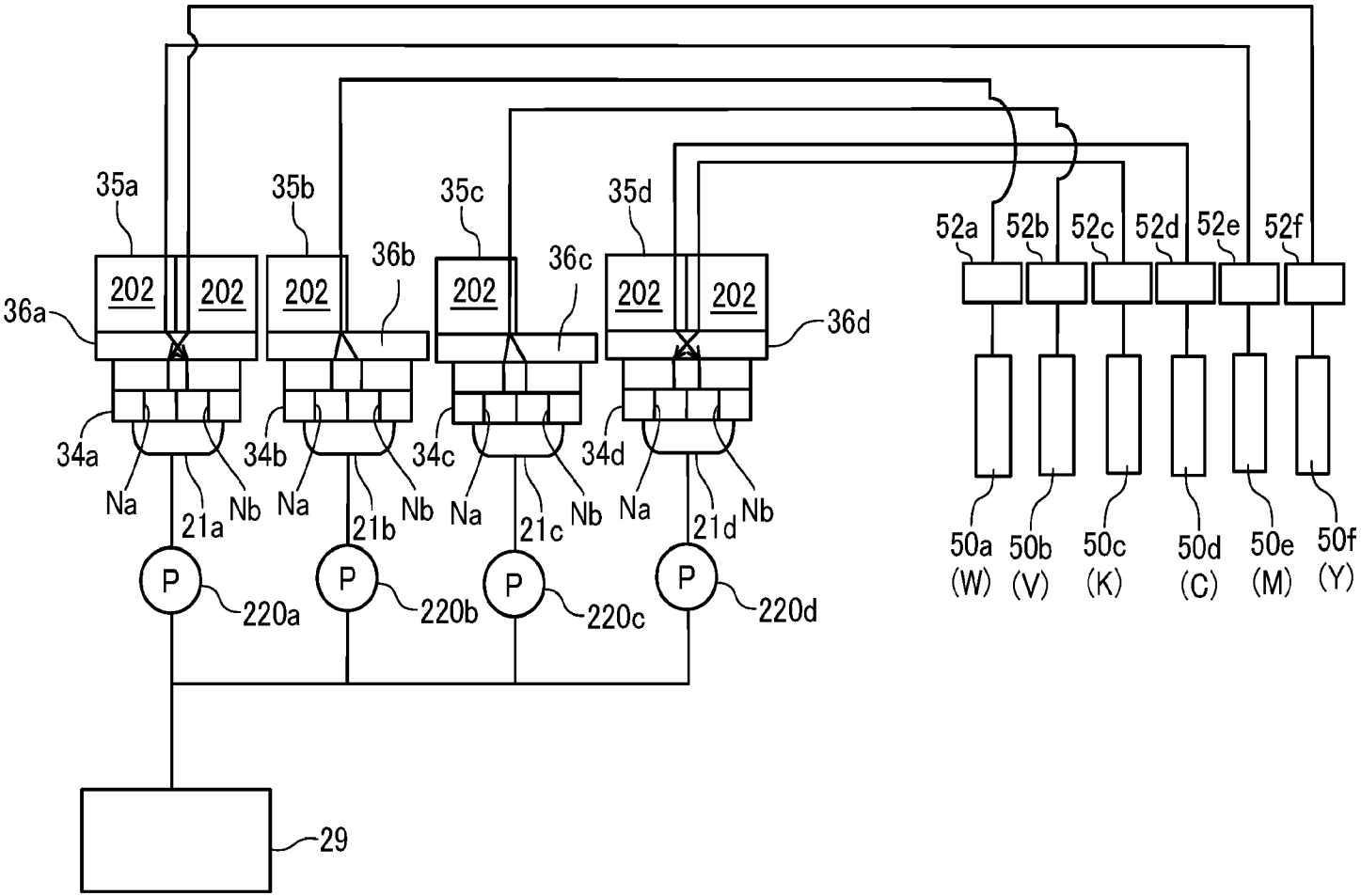
FIG. 9 is a schematic diagram of a supply system and a discharge system of the liquid discharge apparatus according to a second embodiment of the present disclosure.

A second embodiment of the present disclosure is described with reference to FIG. 9. FIG. 9 is a schematic diagram of the supply system and the discharge system of the liquid discharge apparatus 1000 according to the second embodiment of the present disclosure.

In the present (second) embodiment, the maintenance unit 20 includes suction caps 21*a* to 21*d* respectively cap the heads 34*a* to 34*d* and suction pumps 220*a* to 220*d* respectively connected to the suction caps 21*a* to 21*d*. Thus, each of the suction caps 21*a* to 21*d* can independently sucks (vacuums) the liquid from corresponding one of the heads 34*a* to 34*d*.

Figure 10:
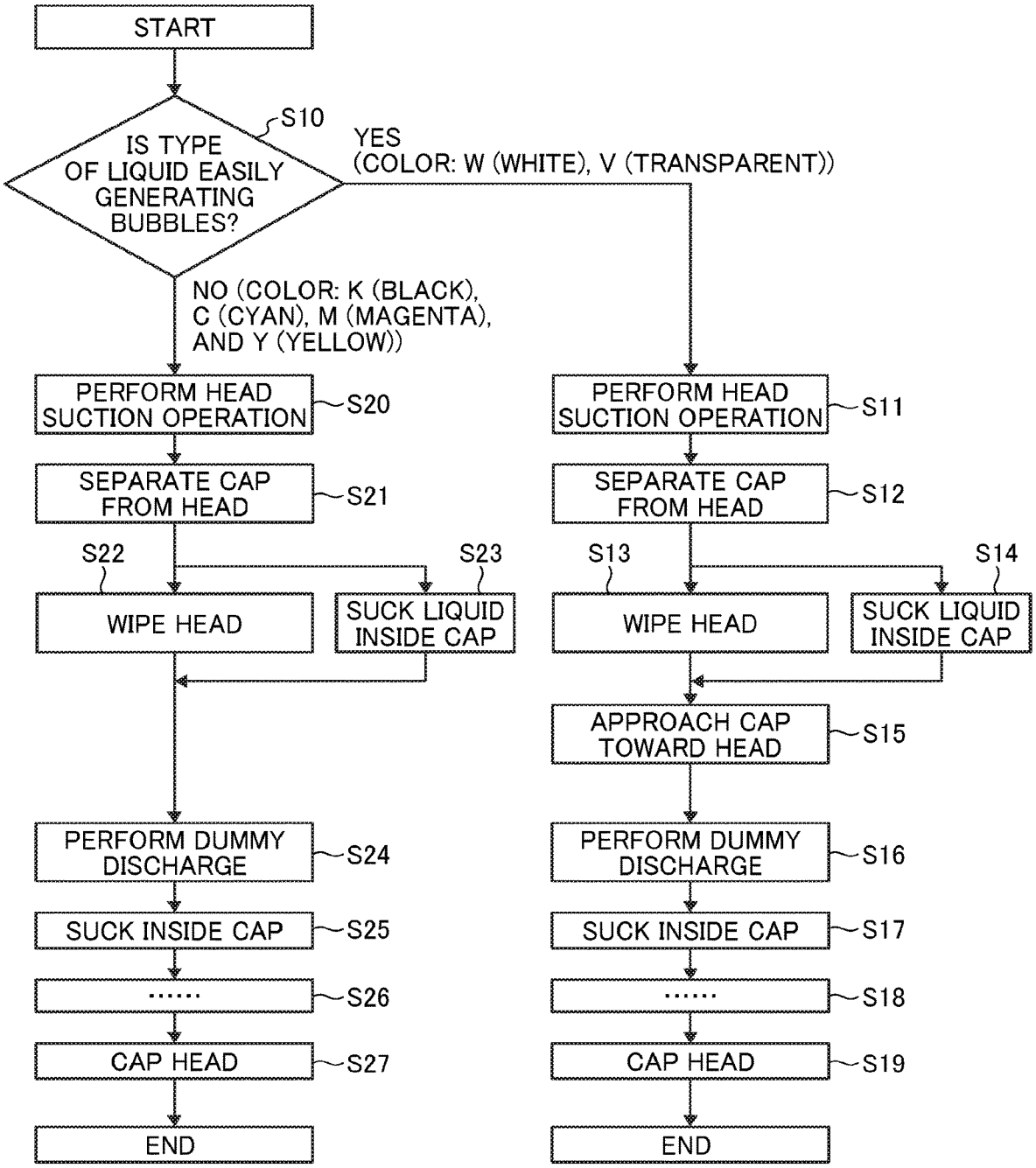
FIG. 10 is a flowchart of a control of a maintenance operation according to the second embodiment of the present disclosure.

Next, a control of the maintenance operation in the present (second) embodiment is described with reference to a flowchart of FIG. 10.

In the present (second) embodiment, the controller 500 performs the first maintenance operation similarly to the above-described first embodiment according to a type of liquid (ink) discharged from the head 34 that is an object to be sucked (vacuumed). Specifically, the controller 500 performs the first maintenance operation if the liquid discharged by the head 34 is a type easily generating bubbles. Conversely, if the liquid (ink) to be discharged is a type not easily generating bubbles, the controller 500 performs the second maintenance operation that does not include the cap approaching operation (S5) in the first maintenance operation.

When the maintenance operation (cleaning operation) is started, the controller 500 determines whether the type of liquid discharged from the head 34 to be sucked (vacuumed) is the type easily generating bubbles (S10).

The controller 500 performs the first maintenance operation similar to the steps S1 to S9 in the first embodiment (S11 to S19) if the liquid is the type easily generating bubbles, for example, the liquids of colors of white (W) and transparent (V).

Conversely, the controller 500 performs the second maintenance operation that does not include the cap approaching operation (S5) in the first embodiment (S20 to S27) if the liquid is the type not easily generating bubbles, for example, the liquids of colors of black (K), cyan (C), magenta (M), and yellow (Y).

Thus, the head 34 is capped with the suction cap 21, and the suction pump 220 is driven to perform the head suction operation (S20) in the second maintenance operation. Then, the controller 500 separates the suction cap 21 from the nozzle surface 341 of the head 34 (open cap: S21), wipes the nozzle surface 341 of the head 34 by the wiper 23 (S22), and performs the in-cap suction operation (S23).

Next, the head 34 performs the dummy discharge to discharge a liquid not contributing to an image formation to an interior of the suction cap 21 (S24), and in-cap suction operation is performed (S25). Then, the nozzle surface 341 of the head 34 is capped with the suction caps 21*a* to 21*d* (S27) after performing other operations (S26). Then, the cleaning operation is end.

As described above, the controller 500 performs the first the first maintenance operation or the second maintenance operation according to whether the type of the liquid discharged from the head 34 is the type easily generating bubbles. Thus, the cap approaching operation (S5) can be omitted for a head 34 that discharges a liquid that does not easily generate bubbles.

Thus, the liquid discharge apparatus 1000 can reduce time of the cleaning operation (maintenance operation) as compared with the cleaning operation in which the first maintenance operation is performed for all the types of liquids.

Figure 11:
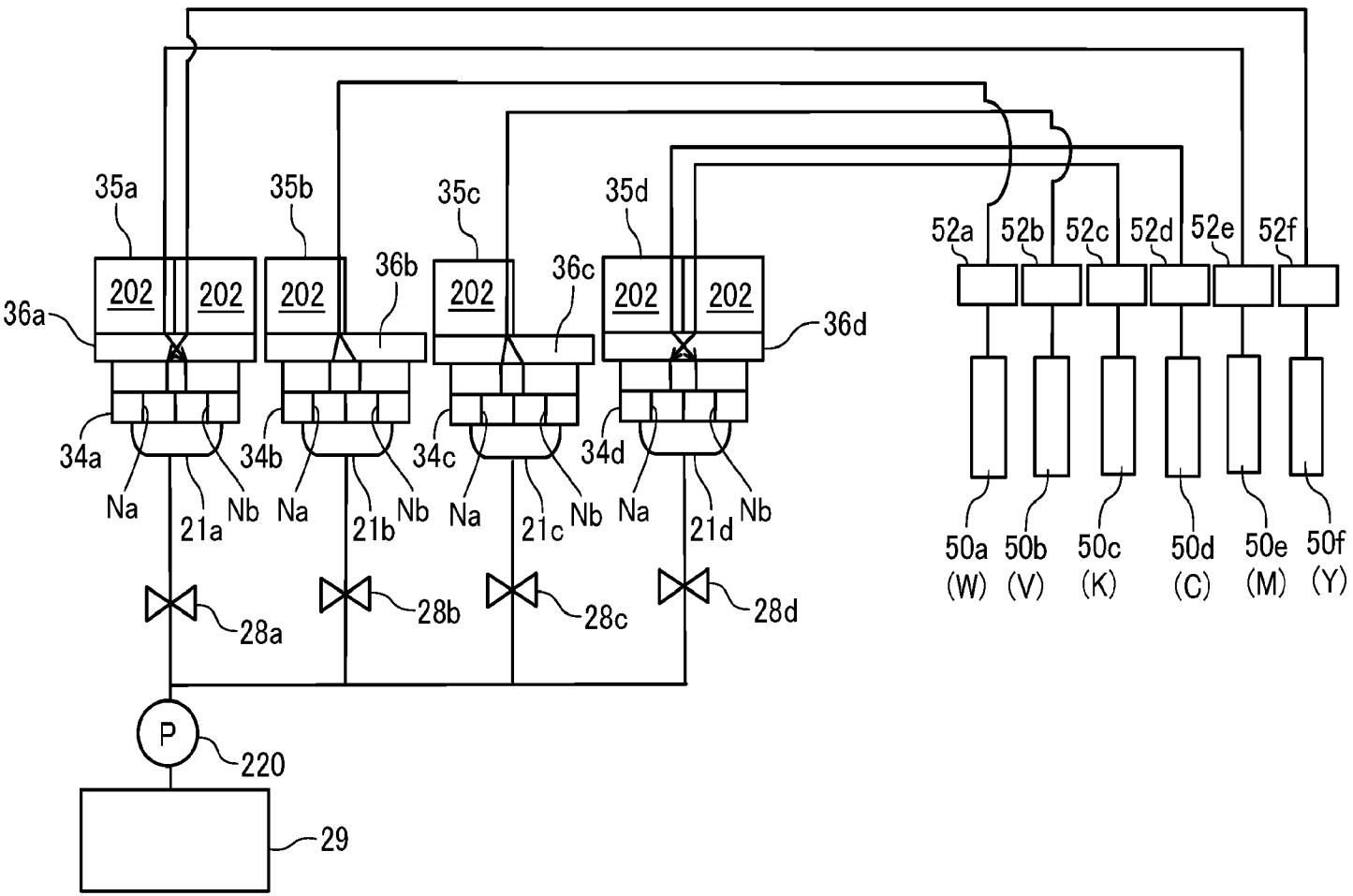
FIG. 11 is a schematic diagram of a supply system and a discharge system of the liquid discharge apparatus according to a third embodiment of the present disclosure.

A third embodiment of the present disclosure is described with reference to FIG. 11. FIG. 11 is a schematic diagram of the supply system and the discharge system of the liquid discharge apparatus 1000 according to the third embodiment of the present disclosure.

The maintenance unit 20 in the present (third) embodiment includes suction caps 21*a* to 21*d* for each heads 34, one suction pump 220 connected to each of the suction caps 21*a* to 21*d*, and an opening-and-closing valves 28*a* to 28*d* to open and close the suction channels between the suction pump 220 and the suction caps 21*a* to 21*d*. The opening-and-closing valves 28*a* to 28*d* may be a switching means to switch the suction channels.

The maintenance unit 20 can individually perform the head suction operation (S1) on each heads 34. However, the maintenance unit 20 sequentially performs the cleaning operation while sequentially opening and closing the opening-and-closing valves 28*a* to 28*d* to switch the suction channels between the suction pump 220 and the suction caps 21*a* to 21*d*.

Figure 12:
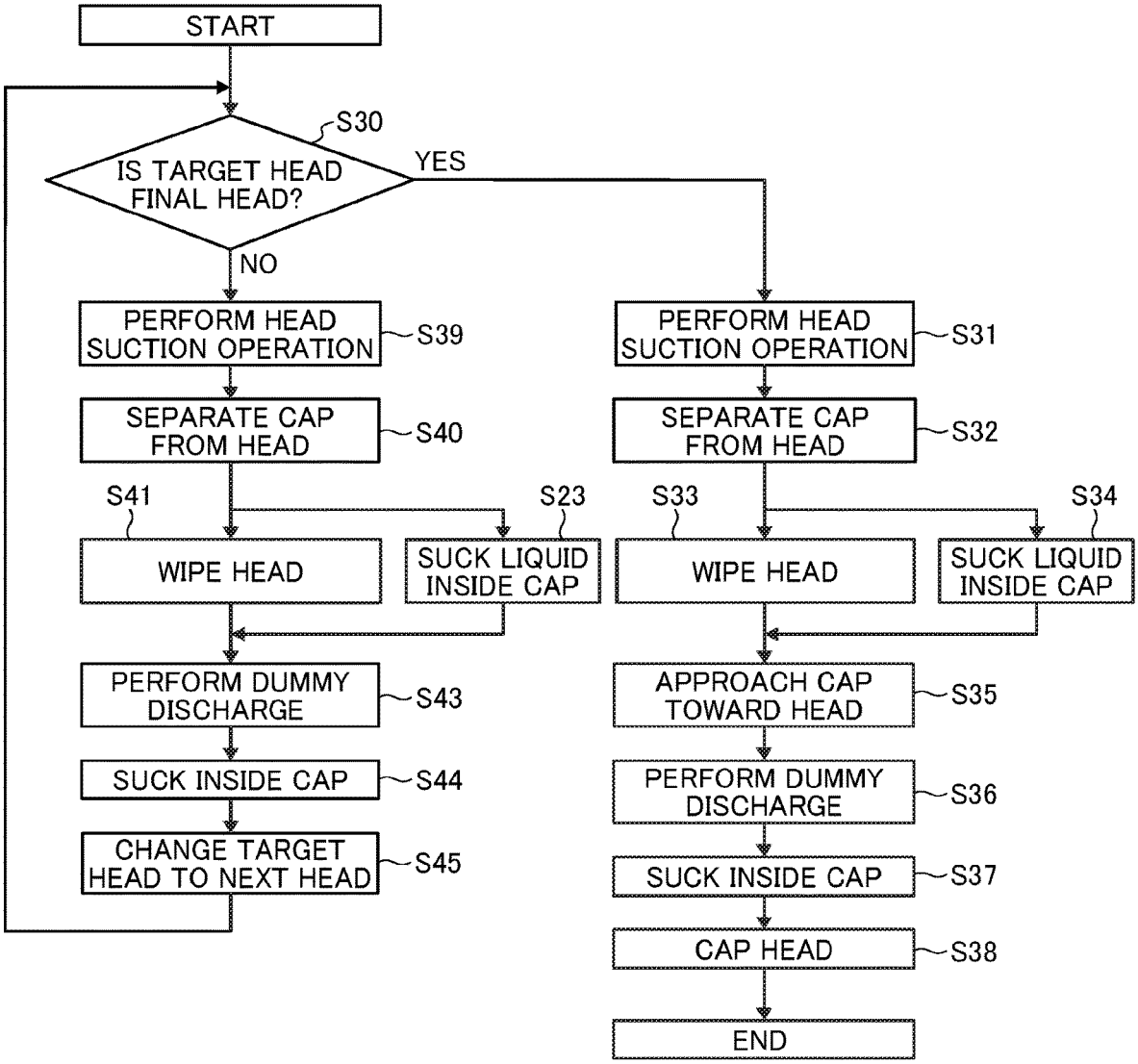
FIG. 12 is a flowchart of a control of a maintenance operation according to the third embodiment of the present disclosure.

Next, a control of the maintenance operation in the present (third) embodiment is described with reference to a flowchart of FIG. 12.

In the present (third) embodiment, when the cleaning operation is performed on the plurality of heads 34, the controller 500 performs the first maintenance operation on a final head 34 that is the last (final) head 34 to be sucked (vacuumed) and cleaned (maintained). Further, the controller 500 performs the second maintenance operation that does not include the cap approaching operation (S5) in the first maintenance operation on the heads 34 other than the final head 34.

When the maintenance operation (cleaning operation) for a plurality of heads 34 is started, the controller 500 determines whether the head 34 to be cleaned (target head) is the final head 34 to be cleaned (S30).

The controller 500 performs the first maintenance operation when the head 34 is the final head 34 to be cleaned. Thus, the head 34 is capped with the suction cap 21, and the suction pump 220 is driven to perform the head suction operation (S31). Then, the controller 500 separates the suction cap 21 from the nozzle surface 341 of the head 34 (open cap: S32), wipes the nozzle surface 341 of the head 34 by the wiper 23 (S33), and performs the in-cap suction operation (S34).

Then, the controller 500 moves the carriage 3 to the head suction position, and performs a cap approaching operation (S5) to move the suction cap 21 toward or away from the head 34 by a predetermined amount (S35).

Next, the head 34 performs the dummy discharge to discharge a liquid not contributing to an image formation to an interior of the suction cap 21 (S36), and in-cap suction operation is performed (S37). Then, the heads 34 are capped with the suction cap 21 and the moisture-retention caps 22 (S38). Then, the cleaning operation is end.

Conversely, the controller 500 performs the second maintenance operation when the head 34 to be cleaned is not the final head 34 to be cleaned. Thus, the head 34 is capped with the suction cap 21, and the suction pump 220 is driven to perform the head suction operation (S39). Then, the controller 500 separates the suction cap 21 from the nozzle surface 341 of the head 34 (open cap: S40), wipes the nozzle surface 341 of the head 34 by the wiper 23 (S41), and performs the in-cap suction operation (S42).

Next, the head 34 performs the dummy discharge to discharge a liquid not contributing to an image formation to an interior of the suction cap 21 (S34), and in-cap suction operation is performed (S44). Then, the head 34 to be cleaned is set to a next head 34 (S45), and the process returns to the step S30.

If there are bubbles 300 in the suction cap 21 before cleaning the final head 34, the head 34 other than the final head 34 is subjected to the cleaning operation even if the bubbles 300 are in contact with the head 34. Thus, the liquid of mixed colors does not enter into the nozzles 342 of the heads 34.

Thus, as described above, the controller 500 performs one of the first maintenance operation and the second maintenance operation according whether the head 34 to be cleaned is the final head 34. Thus, the controller 500 can perform the second maintenance operation that does not include the cap approaching operation (S5) on the heads 34 other than the final head 34.

Thus, the controller 500 can reduce time of the cleaning operation (maintenance operation) as compared with the cleaning operation in which the first maintenance operation is performed for all the heads 34.

If there are bubbles in the suction cap 21 before cleaning the final head 34, the head 34 is subjected to a cleaning operation even if the bubble are attached on the nozzle surface 341 of the head 34. Thus, the liquid of mixed colors does not enter into the nozzles 342 of the heads 34.

In the present embodiment, discharged liquid is not limited to a particular liquid as long as the liquid has a viscosity or surface tension to be discharged from a head (liquid discharge head).

However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The term "liquid discharge apparatus" used herein also represents an apparatus including the head or the liquid discharge device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The liquid discharge apparatus is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media such as a paper sheet, recording paper, and a recording sheet of paper, film, and cloth, electronic components such as an electronic substrate and a piezoelectric element, and media such as a powder layer, an organ model, and a testing cell. The "material on which liquid can be adhered" includes any material on which liquid adheres unless particularly limited.

Examples of the "material on which liquid can be adhered" include any materials on which liquid can be adhered even temporarily, such as paper, thread, fiber, fabric, leather, metal, plastic, glass, wood, and ceramic.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on the surface of the sheet to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Any one of the above-described operations may be performed in various other ways, for example, in an order different from the one described above. The methods described above can be provided as program codes stored in a recording medium, to cause a processor to execute the method when executed by at least one processor.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus, comprising:

a liquid discharge head configured to discharge a liquid;

a cap configured to approachably separable from the liquid discharge head;

a suction pump connected to the cap; and circuitry configured to control the cap and the suction pump to perform a maintenance operation, wherein the maintenance operation includes:

a head suction operation to cap the liquid discharge head with the cap and drive the suction pump to vacuum the liquid from the liquid discharge head;

an in-cap suction operation to, after the head suction operation, move the cap away from the liquid discharge head and then drive the suction pump to discharge the liquid from the cap; and a cap approaching operation to, after the in-cap suction operation when the cap is away from the liquid discharge head, move the cap toward the liquid discharge head, and then move the cap away from the liquid discharge head.

2. The liquid discharge apparatus according to claim 1, wherein the cap approaching operation moves the cap toward the liquid discharge head to contact the liquid discharge head with the cap.

3. The liquid discharge apparatus according to claim 1, further comprising a plurality of liquid discharge heads including the liquid discharge head, wherein the plurality of liquid discharge heads includes:

a first liquid discharge head configured to discharge liquids of different colors; and a second liquid discharge head configured to discharge liquids of different colors.

4. The liquid discharge apparatus according to claim 3, wherein the circuitry is further configured to:

perform the maintenance operation on the first liquid discharge head; and perform another maintenance operation on the second liquid discharge head, said another maintenance operation including the head suction operation and the in-cap suction operation without the cap approaching operation.

5. The liquid discharge apparatus according to claim 4, wherein the circuitry is further configured to perform one of the maintenance operation and said another maintenance operation on each of the plurality of liquid discharge heads according to a type of a liquid discharged from each of the plurality of liquid discharge heads.

6. The liquid discharge apparatus according to claim 5, wherein the circuitry is further configured to:

perform the maintenance operation on the first liquid discharge head that discharges a first type of liquid; and perform the another maintenance operation on the second liquid discharge head that discharges a second type of liquid, the second type of liquid being a liquid that generates fewer bubbles than the first type of liquid.

7. The liquid discharge apparatus according to claim 6, further comprising:

a plurality of caps including the cap, the plurality of caps respectively capping the plurality of liquid discharge heads; and a plurality of suction pumps including the suction pump, the plurality of suction pumps respectively connected to the plurality of caps, wherein the circuitry is further configured to perform one of the maintenance operation and said another maintenance operation on each of the plurality of liquid discharge heads according to the type of the liquid discharged from each of the plurality of liquid discharge heads.

8. The liquid discharge apparatus according to claim 3, wherein the circuitry is further configured to:

perform the maintenance operation on a particular liquid discharge head to be maintained among the plurality of liquid discharge heads; and perform another maintenance operation on the plurality of liquid discharge heads other than the particular liquid discharge head, said another maintenance operation including the head suction operation and the in-cap suction operation without the cap approaching operation.

9. The liquid discharge apparatus according to claim 8, further comprising:

a plurality of caps including the cap, the plurality of caps respectively capping the plurality of liquid discharge heads, a plurality of opening-and-closing valves to respectively connect or disconnect a plurality of channels connecting the plurality of caps and the suction pump, wherein the circuitry is further configured to:

perform the maintenance operation on the particular liquid discharge head; and perform said another maintenance operation on the plurality of liquid discharge heads other than the particular liquid discharge head.

10. The liquid discharge apparatus of claim 1, further comprising a wiper, wherein the circuitry is further configured to cause the wiper to wipe the liquid discharge head after the head suction operation, but before the cap approaching operation.

11. A head maintenance method of maintaining a liquid discharge head that discharges a liquid, the method comprising:

performing a head suction operation to cap the liquid discharge head with a cap and drive a suction pump connected to the cap to discharge a liquid from the liquid discharge head;

performing, after the head suction operation, an in-cap suction operation to move the cap away from the liquid discharge head and then drive the suction pump to discharge the liquid from the cap; and performing a cap approaching operation, after the in-cap suction operation when the cap is away from the liquid discharge head, to move the cap toward the liquid discharge head, and then move the cap away from the liquid discharge head.

* * * * *